US006817171B2

(12) United States Patent
Zhu

(10) Patent No.: US 6,817,171 B2
(45) Date of Patent: Nov. 16, 2004

(54) SYSTEM AND METHOD FOR PREDICTING CONCENTRATION OF UNDESIRABLE EXHAUST EMISSIONS FROM AN ENGINE

(75) Inventor: Dannie Zhu, Lake Orion, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 41 days.

(21) Appl. No.: 10/347,025

(22) Filed: Jan. 17, 2003

(65) Prior Publication Data

US 2004/0139735 A1 Jul. 22, 2004

(51) Int. Cl.[7] ..... F01N 3/00

(52) U.S. Cl. ..... 60/274; 60/276; 123/435; 701/102

(58) Field of Search ..... 60/274, 276, 285, 60/286; 123/406.48, 435, 519; 701/102, 103, 104, 115, 108

(56) References Cited

U.S. PATENT DOCUMENTS 5,595,060 A * 1/1997 Togai et al. ..... 60/274
5,740,669 A * 4/1998 Kinugasa et al. ..... 60/285
6,012,435 A * 1/2000 Takahashi et al. ..... 123/519
6,279,537 B1 * 8/2001 Yonekura et al. ..... 123/406.48
6,425,372 B1 * 7/2002 Hiltner ..... 123/435
6,505,465 B2 * 1/2003 Kanazawa et al. ..... 60/278
2003/0191575 A1 * 10/2003 Wright ..... 701/104

FOREIGN PATENT DOCUMENTS

JP 2001-153353 * 6/2001
WO WO 02/18762 A1 * 3/2002

* cited by examiner

*Primary Examiner*—Tu M. Nguyen
(74) *Attorney, Agent, or Firm*—Edwin W. Bacon, Jr.

(57) ABSTRACT

A method for predicting the concentration of one or more undesirable exhaust emissions, such as NOx or HC, from an internal combustion engine. The method determines a mass flow ($m_{(a)}$) of the charge of air supplied to the engine, the rotational speed ($\omega$) of the engine, a fuel-equivalence ratio ($\phi$) and an array of look-up tables to predict the concentration of the undesirable exhaust emissions. In some instances, the methodology employs an intermediate term to simply the relationship between the variables to achieve a corresponding simplification of the array of look-up tables. An engine control system that predicts the concentration of one or more undesirable exhaust emissions is also provided.

4 Claims, 3 Drawing Sheets

SYSTEM AND METHOD FOR PREDICTING CONCENTRATION OF UNDESIRABLE EXHAUST EMISSIONS FROM AN ENGINE

FIELD OF THE INVENTION

The present invention generally relates the prediction of emissions from internal combustion engines and more particularly to a method for predicting NOx and HC emissions from an internal combustion engine and an engine control system that utilizes said method.

BACKGROUND OF THE INVENTION

With increasingly strict regulations on the emissions of the internal combustion engine, automobile manufacturers are expending significant efforts to further reduce the levels of undesirable exhaust emissions. Unburnt hydrocarbons (HC) and oxides of nitrogen (NOx) are particularly important, as NOx emissions are known to be respiratory irritants and HC emissions that are heavier than methane and NOx emissions are known to aid in the formation of smog. While sensors for NOx and HC are known, such sensors are relatively expensive so vehicles are not routinely equipped with them for the direct measurement and corresponding control of NOx and HC emissions.

Furthermore, HC and especially NOx emissions were generally not considered to be predictable. For example, NOx is not produced in the combustion reaction, but rather results from the combustion reaction. At the elevated temperatures within a cylinder during a combustion event, dynamic nitrogen and oxygen molecules disassociate and recombine with one another to form NO and NO2. The mass of NOx that is formed depends on the temperature within the cylinder and the amount of time that the dynamic nitrogen and oxygen are subjected to the heat.

As such, many modern automobile manufacturers have based the control of an engine for emissions purposes on the amount of carbon dioxide that is produced during a combustion event. Because the combustion reaction is defined by a known chemical reaction, and because the amount of the reactants (i.e., air and fuel) input to the engine are known, the amount of carbon dioxide produced during a combustion event can be predicted with relatively high accuracy.

As those skilled in the art will appreciate, while NOx and HC emissions can be generally associated with the amount of carbon dioxide that is produced, such associations are not wholly accurate as they are highly focused on the chemical reaction and do not fully consider other aspects of the reaction, such as the amount of time available for the reaction. Accordingly, there remains a need in the art for a method by which combustion byproducts, such as NOx and HC may be more accurately predicted.

SUMMARY OF THE INVENTION

In one preferred form, the present invention provides a method for predicting a concentration of at least one undesirable exhaust emission discharged from an internal combustion engine that employs a charge of air and a charge of fuel for producing a combustion event that produces power. The method includes the steps of: determining a mass flow ($m_{(a)}$) of the charge of air; determining a rotational speed ($\omega$) of the engine; determining a fuel-equivalence ratio ($\phi$) associated with the charge of air and the charge of fuel; and employing the mass flow ($m_{(a)}$) of the charge of air, the rotational speed ($\omega$), the fuel-equivalence ratio ($\phi$) and an array of look-up tables to determine the concentration of the at least one undesirable exhaust emission.

The method of the present invention overcomes the aforementioned drawbacks by permitting the concentration of various undesirable exhaust emissions, such as NOx and/or HC, to be predicted with generally improved accuracy over a wide range of operating conditions. In a preferred form, intermediate terms are employed to greatly simplify the relationship between various engine parameters, such as rotational speed and mass air flow, to thereby permit the use of greatly simplified arrays of look-up tables that are readily incorporated into the memory of an engine controller.

In another preferred form, the present invention provides an engine control system for a motor vehicle having an internal combustion engine. The internal combustion engine utilizes a charge of air and a charge of fuel to support a combustion event that produces power and at least one undesirable exhaust emission. The engine control system includes a first sensor, at least one second sensor and an engine controller. The first sensor is coupled to the engine and operable for both sensing a rotational speed ($\omega$) of the engine and producing a first sensor signal in response thereto. The at least one second sensor senses at least one of a mass air flow and a throttle position and produces at least one second sensor signal in response thereto. The engine controller receives a plurality of sensor signals including the first sensor signal and the at least one second sensor signal wherein the plurality of sensor signals are indicative of an operating condition of the internal combustion engine so as to permit the engine controller to determine a mass flow ($m_{(a)}$) of the charge of air, the rotational speed ($\omega$) and a fuel-equivalence ratio ($\phi$). The engine controller includes a memory having pre-programmed therein an array of look-up tables. The engine controller employs the mass flow ($m_{(a)}$) of the charge of air, the rotational speed ($\omega$), the fuel-equivalence ratio ($\phi$) and the array of look-up tables to predict a concentration of the at least one undesirable exhaust emission that is generated during the combustion event.

The engine control system of the present invention overcomes the aforementioned drawbacks by permitting the concentration of various undesirable exhaust emissions, such as NOx and/or HC, to be relatively accurately predicted so that costly dedicated sensors, such as NOx sensors or smoke sensors, are not required.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
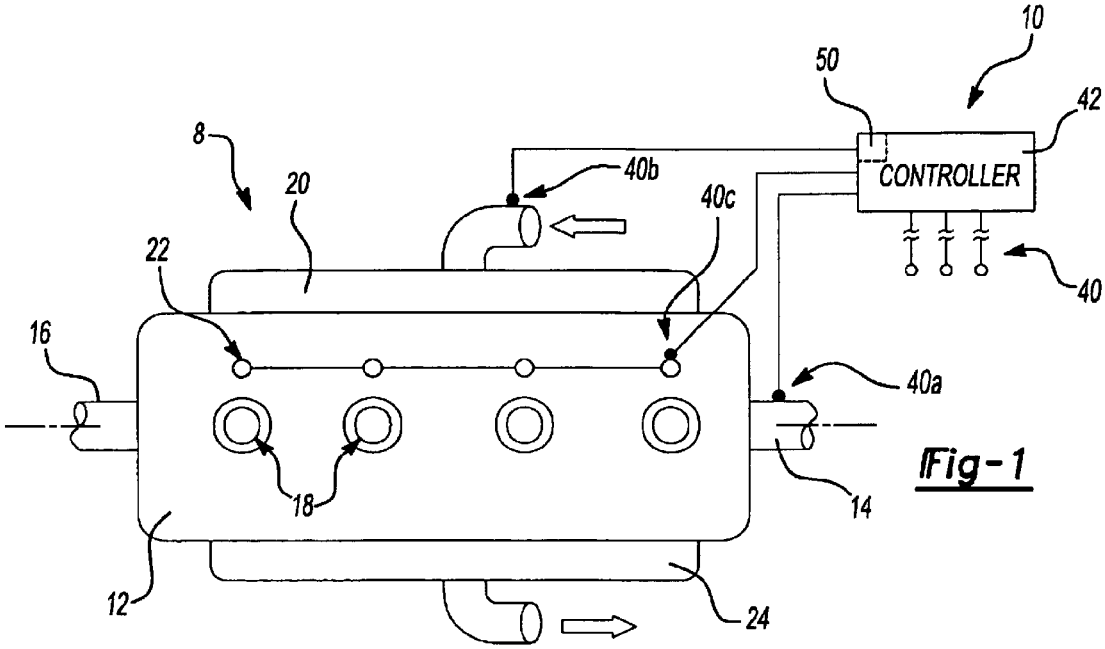
FIG. 1 is a schematic illustration of a motor having an engine control system constructed in accordance with the teachings of the present invention.

With reference to FIG. 1 of the drawings, an engine assembly 8 that is adapted for use in an automotive vehicle and having an engine control system 10 constructed in accordance with the teachings of the present invention is schematically illustrated. The engine assembly 8 also conventionally includes an engine block 12, a crankshaft 14, a camshaft 16, a plurality of piston assemblies 18, an air intake system 20, a fuel system 22 and an exhaust system 24; these components are well know to even those of modest skill in the art and as such, a detailed discussion of the construction and operation of these conventional components is not necessary. Briefly, the crankshaft 14 and camshaft 16 are rotatably housed in the engine block 12. Each of the piston assemblies 18 is housed in an associated cylinder bore in the engine block 12 and conventionally includes a connecting rod (not shown), which is journally coupled to the crankshaft 14, and a piston (not specifically identified) that is slidingly disposed in the cylinder bore.

The air intake system 20 and fuel system 22 cooperate to provide (in a predetermined sequence) a charge of air and a charge of fuel, respectively, to each cylinder bore that is employed to support a combustion event within the cylinder bore. In the particular example provided, the combustion event in each cylinder bore is initiated by a spark generating device, such as a conventional spark plug (not shown). Those skilled in the art will appreciate, however, that other means may be employed for initiating the combustion event, such as elevated temperatures and pressures within the cylinder bore. The gasses produced in the combustion event push the piston within the cylinder bore, causing the connecting rod to rotate the crankshaft 14 to provide a vehicle drive train (e.g., transmission) with a source of rotary power as well as to rotate the camshaft 16 and other accessories via drive chains, drive belts and/or gear trains.

The camshaft 16 is employed to open various valves (e.g., exhaust valves and intake valves) to permit each cylinder bore to breath according to a predetermined sequence. Modernly, most automotive motors are of the 4-cycle variety, having both exhaust and intake valves. Accordingly, the camshaft 16 selectively opens one or more intake valves to permit the air intake system 20 to provide a cylinder bore with a charge of air and selectively opens one or more exhaust valve to permit combustion gasses to be discharged from a cylinder bore to the exhaust system 24.

The engine control system 10 is employed to control the fueling and operation of the engine assembly 8 in a manner that promotes fuel efficiency as well as maintains the level of undesirable emission byproducts, such as NOx and HC, below a predetermined threshold. Those skilled in the art will appreciate that the methodology and system of the present invention are intended to supplement the known emissions reduction techniques rather than to replace them. Accordingly, the those skilled in the art will appreciate that well known pre-combustion and post-combustion techniques may also (and preferably are) employed with the methodology and system of the present invention. Examples of suitable pre-combustion techniques include changes to spark timing and the recirculation of exhaust gases, while examples of suitable post-combustion techniques include catalytic converters and particulate traps.

The engine control system 10 indudes a plurality of sensors 40 and an engine controller 42. The plurality of sensors 40 are operable for sensing various operating conditions and characteristics of the engine assembly 8 and generating associated sensor signals In response thereto. In particular, the plurality of sensors 40 includes a first sensor 40*a*, which senses the rotational speed (ω) of the engine assembly 8 (e.g. the rotational speed of the crankshaft 14), at least one second sensor 40*b*, which permits the mass air flow of air used as the charge of air that is delivered to a cylinder bore for use in a combustion event, and at least one third sensor 40*c* that permits the mass flow of fuel used as the charge of fuel that is delivered to a cylinder bore for use in a combustion event. Such sensors are well known In the art and commercially available and as such, the construction and operation of such sensors is well understood by those of ordinary skill in the art. Consequently, a detailed discussion of the construction and operation of such sensors need not be provided herein.

Those skilled in the art will also appreciate that such sensors (e.g., sensors 40*b* and 40*c*) need not directly sense a given characteristic (e.g., mass flow of air or mass flow of fuel), but may alternatively sense characteristics that are strongly or directly related to the given characteristic so that the magnitude of the given characteristic can be determined by its relationship to the sensed characteristic. For example, a conventional mass flow sensor (not shown) may be employed to directly sense the mass flow of air that is being delivered to the engine assembly 8 for use in combustion. Alternatively, a conventional throttle position sensor (not shown) may be employed to sense the magnitude of the throttle opening; based on the size of the opening and various other operating conditions and characteristics of the engine assembly 8, such as rotational speed, ambient air temperature, etc., the mass flow of air that is being delivered to the engine assembly 8 for use in combustion may be determined, rather than directly sensed.

The engine controller 42 is coupled to the plurality of sensors 40 and receives the plurality of sensor signals so that the engine controller 42 is able to determine a mass flow ($m_{(a)}$) of the charge of air, the rotational speed (ω) and a fuel-equivalence ratio (ϕ). The mass flow ($m_{(a)}$) of the charge of air, the rotational speed (ω) and the fuel-equivalence ratio (ϕ) are terms well known in the art and as such, a detailed discussion of the manner in which they are determined need not be provided herein.

Figure 2:
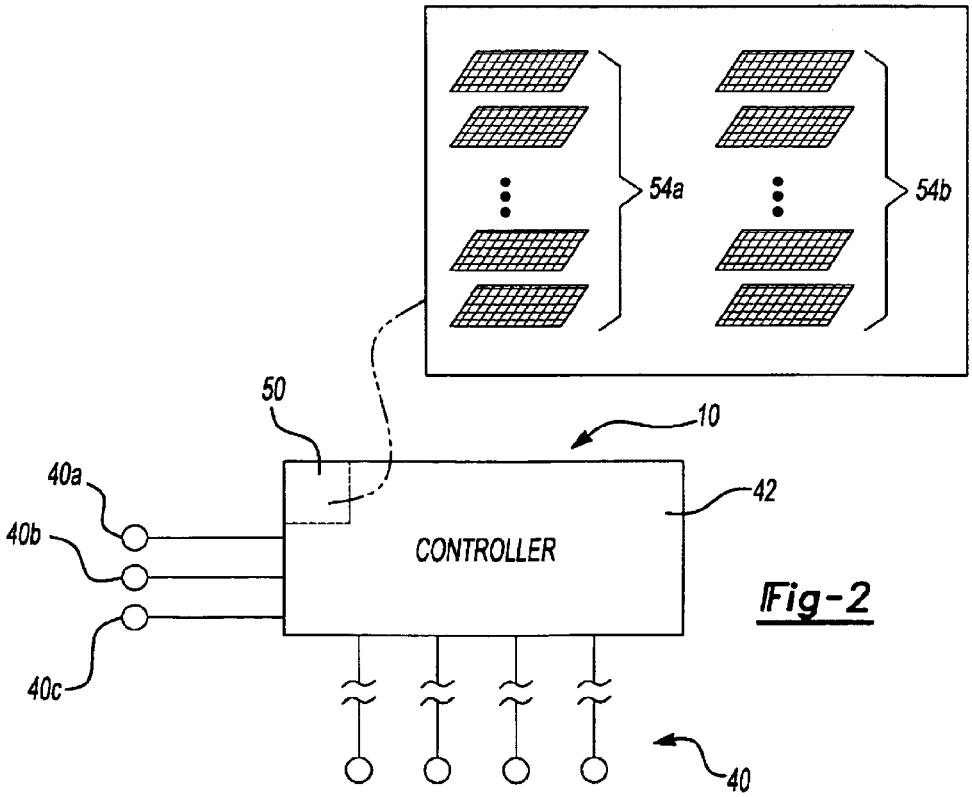
FIG. 2 is an enlarged portion of FIG. 1 illustrating the engine controller in greater detail.

With additional reference to FIG. 2, the engine controller 42 includes a memory 50 having pre-programmed therein an array of look-up tables that are associated with each of the undesirable exhaust emissions whose concentration is to be predicted. In the particular example provided, the undesirable exhaust emissions include both NOx and HC so that two arrays of look-up tables 54*a* and 54*b*, respectively, are employed.

In my research, I have found that the mass flow ($m_{(a)}$) of the charge of air, the rotational speed (ω) and the fuel-equivalence ratio (ϕ) are relevant in predicting the concentration of NOx and HC. In fact, I have found that four-variable arrays (i.e., $m_{(a)}$, ω, ϕ and the concentration of the undesirable exhaust emission) provide extremely accurate predictions for the concentration of the undesirable exhaust emission. As is well known in the art, however, such four-variable arrays are extremely difficult to calibrate and implement.

On further analysis, I have discovered that the above relationship can be somewhat simplified through the use of an intermediate term without unduly reducing the accuracy of the prediction. The intermediate term and the method by which it is calculated varies depending on the particular undesirable exhaust emission that is to be predicted.

Figure 3:
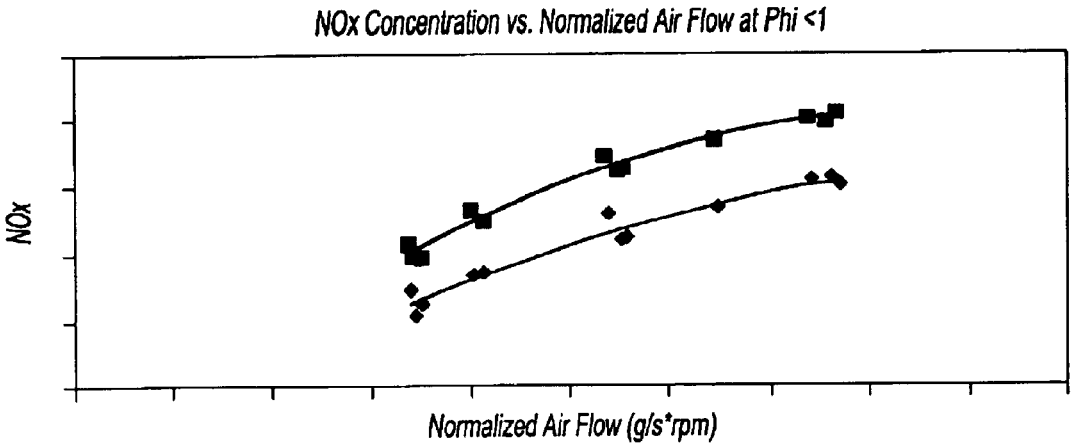
FIGS. 3 through 5 are plots showing NOx concentrations as a function of normalized air flow (NAF) for a given fuel-equivalence ratio ($\phi$)
Figure 4:
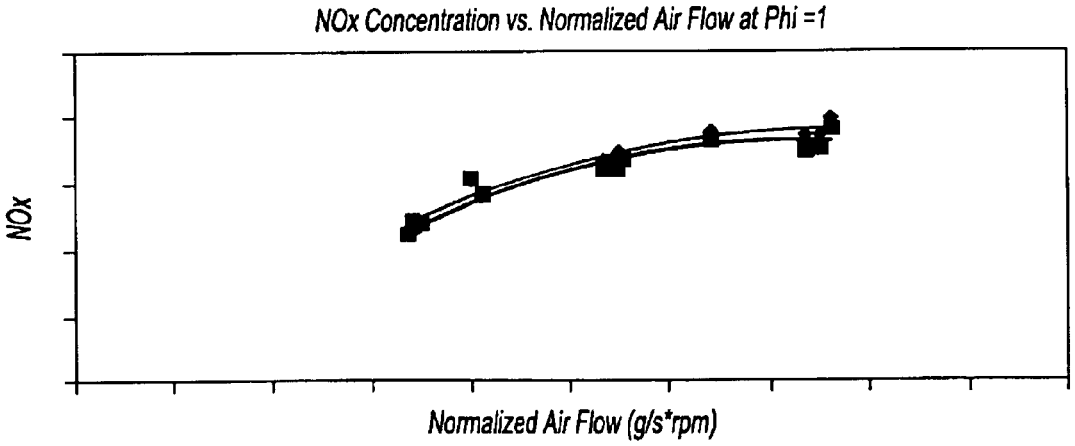
Figure 5:
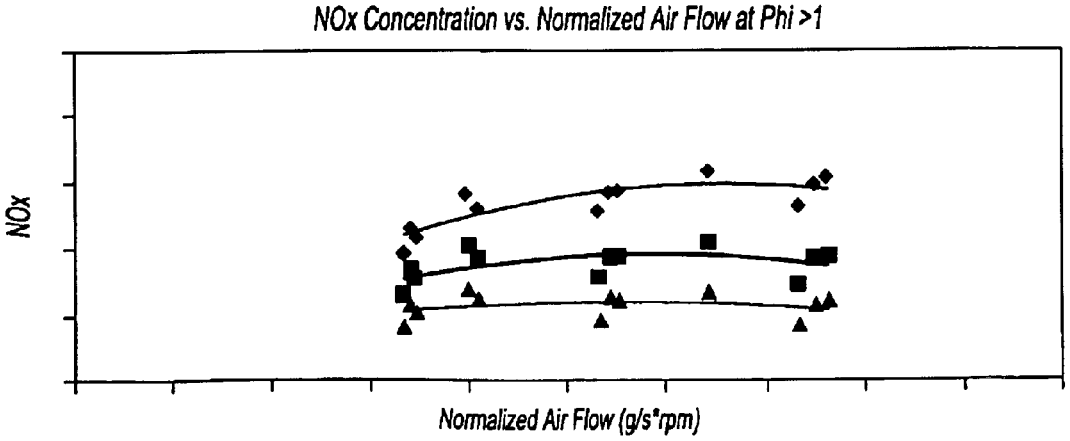
Figure 6:
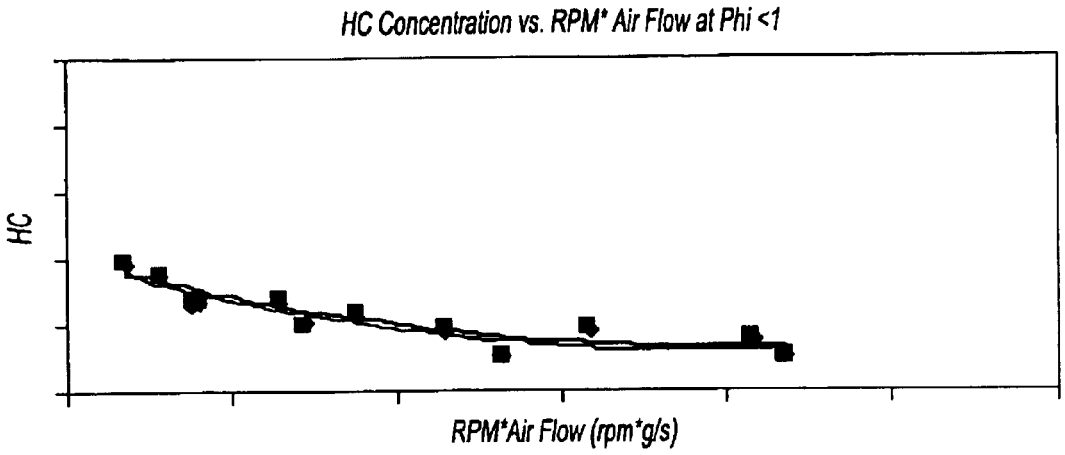
FIGS. 6 through 8 are plots showing HC concentrations as a function of air flow (AF) for a given fuel-equivalence ratio (ϕ).
Figure 7:
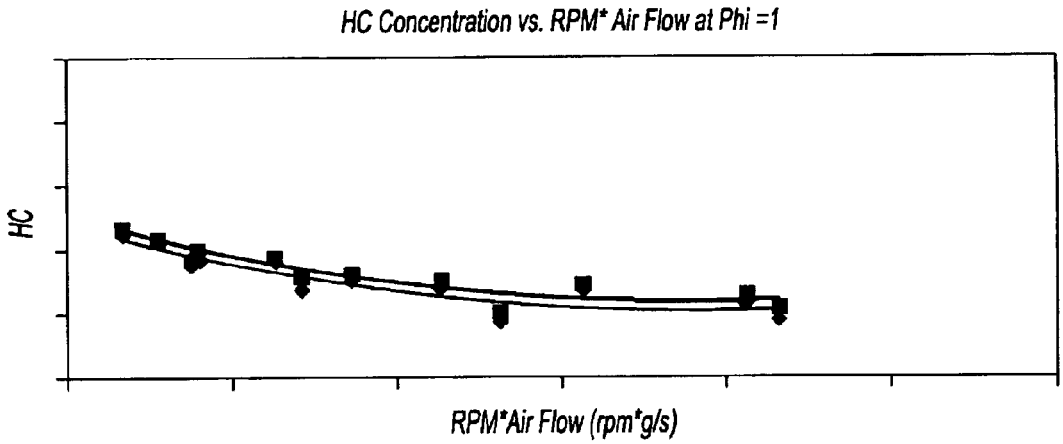
Figure 8:
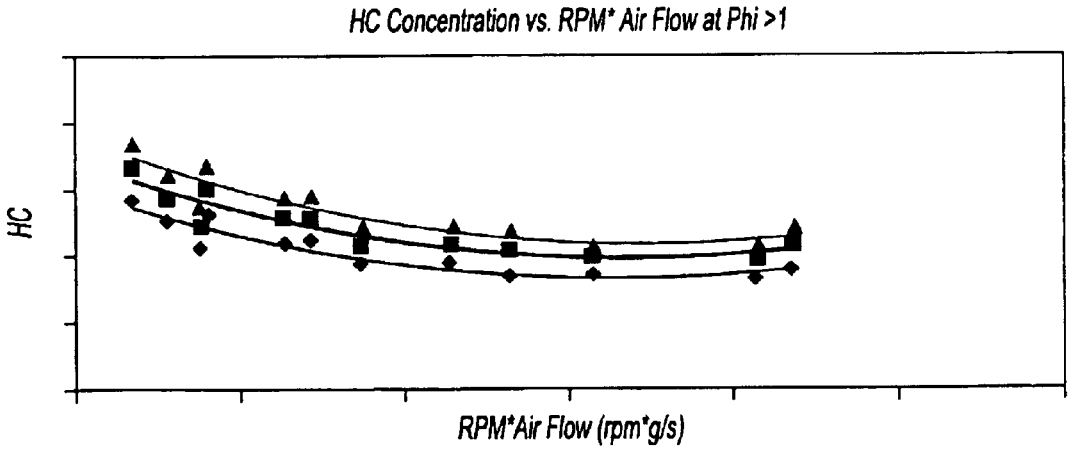

For example, if the concentration of NOx is to be predicted, a normalized air flow (NAF) term may be employed to reduce the relationship to three variables as is shown in FIGS. 3 through 5. In the example provided, the normalized air flow (NAF) term is calculated as follows:

$$NAF=[C\times m_{(a)})]\div(\omega)$$

where C is a predetermined constant, such as 100. Where the concentration of HC is to be predicted, for example, an air flow (AF) term may be employed to reduce the relationship to three variables as is shown in FIGS. 6 through 8. In the example provided, the air flow (AF) term is calculated as follows:

$$AF=[\omega\times m_{(a)})]\div(C)$$

where C is a predetermined constant, such as 10,000.

Those skilled in the art will appreciate that data for each of the arrays of look-up tables 54*a* and 54*b* will be derived experimentally through various tests where, for example, the fuel-equivalence ratio (ϕ) is held constant and engine operating parameters, such as the mass flow ($m_{(a)}$) of the charge of air, the rotational speed (ω) of the engine assembly 8 and the spark timing are varied.

Once the arrays of look-up tables 54*a* and 54*b* are programmed into the memory 50 and the intermediate term (e.g., NAF or AF) and the fuel-equivalence ratio (ϕ) are known, conventional look-up technology that is well known in the art may be employed to quickly and efficiently look-up a prediction value for the concentration a given undesirable exhaust emission.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A method for predicting a concentration of NOx, the engine employing a charge of air and a charge of fuel for producing a combustion event that produces power, the method comprising:

determining a mass flow ($m_{(a)}$) of the chains of air;

determining a rotational speed (ω) of the engine;

determining a fuel-equivalence ratio (ϕ) associated with the charge of air and the charge of fuel;

calculating a normalized air flow (NAF) term as follows:

$$NAF=[100\times m_{(a)})]\div(\omega);\text{ and}$$

employing the value of the normalized air flow (NAF) term, the fuel-equivalence ratio (ϕ) and an array of look-up tables to determine the concentration of NOx.

2. A method for predicting a concentration of HC, the engine employing a charge of air and a charge of fuel for producing a combustion event that produces power, the method comprising:

determining a mass flow ($m_{(a)}$) of the charge of air;

determining a rotational speed (ω) of the engine;

determining a fuel-equivalence ratio (ϕ) associated with the charge of air and the charge of fuel;

calculating an air flow (AF) term as follows:

$$AF=[\omega\times m_{(a)})]\div(C)$$

where C is a predetermined constant; and employing the value of the air flow (AF) term, the fuel-equivalence ratio (ϕ) and an array of look-up tables to determine the concentration of HC.

3. The method of claim 2, wherein the predetermined constant (C) is equal to 10,000.

4. An engine control system for a motor vehicle having an internal combustion engine that utilizes a charge of air and a charge of fuel to support a combustion event that produces power, the combustion event producing at least HC, the engine control system comprising:

a first sensor coupled to the engine and operable for sensing a rotational speed (ω) of the engine and producing a first sensor signal in response thereto;

at least one second sensor for sensing at least one of a mass air flow and a throttle position and producing at least one second sensor signal in response thereto; and an engine controller receiving a plurality of sensor signals including the first sensor signal and the at least one second sensor signal, the plurality of sensor signals being indicative of an operating condition of the internal combustion engine so as to permit the engine controller to determine a mass flow ($m_{(a)}$) of the charge of air, the rotational speed (ω), an air flow (AF) term as follows:

$$AF=[\omega\times m_{(a)})]\div(C)$$

where C is a predetermined constant; and a fuel-equivalence ratio (ϕ), the engine controller including a memory having pre-programmed therein an array of look-up tables, the engine controller employing the AF term, the fuel-equivalence ratio (ϕ) and the array of look-up tables to predict a concentration of the HC that is generated during the combustion event.

* * * * *